US010927693B2

(12) United States Patent
Raghavan et al.

(10) Patent No.: US 10,927,693 B2
(45) Date of Patent: Feb. 23, 2021

(54) UNITARY BODY TURBINE SHROUD FOR TURBINE SYSTEMS

(71) Applicant: General Electric Company, Schenectady, NY (US)

(72) Inventors: Sathyanarayanan Raghavan, Ballston Lake, NY (US); Gautam Suresh Naik, Schenectady, NY (US); Prabhjot Singh, Rexford, NY (US); Zachary John Snider, Simpsonville, SC (US); Changjie Sun, Clifton Park, NY (US)

(73) Assignee: General Electric Company, Schenectady, NY (US)

( * ) Notice: Subject to any disclaimer, the term of this patent is extended or adjusted under 35 U.S.C. 154(b) by 133 days.

(21) Appl. No.: 16/263,596

(22) Filed: Jan. 31, 2019

(65) Prior Publication Data

US 2020/0248559 A1 Aug. 6, 2020

(51) Int. Cl.
*F01D 11/08* (2006.01)
*F01D 25/14* (2006.01)
(Continued)

(52) U.S. Cl.
CPC ..... *F01D 11/08* (2013.01); *F01D 5/143* (2013.01); *F01D 5/20* (2013.01); *F01D 25/14* (2013.01);
(Continued)

(58) Field of Classification Search
CPC ..... F01D 5/143; F01D 11/08; F01D 25/14; F05D 2240/11; F05D 2240/14
See application file for complete search history.

(56) References Cited

U.S. PATENT DOCUMENTS 4,149,824 A 4/1979 Adamson
4,529,355 A 7/1985 Wilkinson
(Continued)

FOREIGN PATENT DOCUMENTS

DE 4223496 A1 1/1994
WO 2015094422 A1 6/2015

OTHER PUBLICATIONS

U.S. Appl. No. 16/263,430, Office Action dated Jul. 13, 2020, 14 pages.
(Continued)

*Primary Examiner* — J. Todd Newton
*Assistant Examiner* — Christopher R Legendre
(74) *Attorney, Agent, or Firm* — Charlotte Wilson; Hoffman Warnick LLC

(57) ABSTRACT

A turbine shroud for turbine systems may include a unitary body including a support portion coupled directly to a turbine casing of the turbine system, and forward hook(s) and aft hook(s) formed integral with the support portion. The unitary body may also include an intermediate portion formed integral with and extending from the support portion. The intermediate portion may include a non-linear segment extending from the support portion, and a forward segment formed integral with the non-linear segment. The forward segment of the intermediate portion may be positioned axially upstream of the forward hook(s). Additionally the unitary body may include a seal portion formed integral with the intermediate portion, opposite the support portion. The seal portion may include a forward end formed integral with the intermediate portion. The forward end may be positioned axially upstream of the forward hook(s).

20 Claims, 10 Drawing Sheets

(51) Int. Cl.
*F01D 5/14* (2006.01)
*F01D 5/20* (2006.01)

(52) U.S. Cl.
CPC ..... *F05D 2240/11* (2013.01); *F05D 2240/14* (2013.01); *F05D 2240/307* (2013.01); *F05D 2260/20* (2013.01)

(56) References Cited

U.S. PATENT DOCUMENTS 4,573,865 A 3/1986 Hsia et al.
6,059,523 A 5/2000 Modafferi et al.
6,059,525 A * 5/2000 Jiomacas ..... F01D 25/246 415/139
6,575,694 B1 6/2003 Thompson et al.
6,779,597 B2 8/2004 DeMarche et al.
6,841,402 B1 1/2005 Hirayanagi
6,913,436 B2 7/2005 McMillan et al.
6,932,566 B2 8/2005 Suzumura et al.
7,011,493 B2 3/2006 Marchi et al.
7,306,424 B2 12/2007 Romanov et al.
7,597,533 B1 10/2009 Liang
7,607,885 B2 * 10/2009 Bosley ..... F01D 25/14 415/121.2
8,353,663 B2 1/2013 Arzel et al.
8,814,507 B1 8/2014 Campbell et al.
9,404,379 B2 8/2016 Mishra
9,611,754 B2 4/2017 Taylor
9,689,276 B2 6/2017 Lefebvre et al.
9,784,125 B2 * 10/2017 Duguay ..... F01D 5/187
10,077,680 B2 9/2018 Thibodeau et al.
2005/0281663 A1 12/2005 Trindade et al.
2009/0214352 A1 8/2009 Ochiai et al.
2010/0111670 A1 5/2010 Shapiro
2013/0156550 A1 6/2013 Franks et al.
2013/0156556 A1 6/2013 Franks et al.
2013/0192257 A1 8/2013 Horine et al.
2016/0305286 A1 * 10/2016 Heitman ..... F02C 3/04
2016/0333741 A1 11/2016 Stapleton
2017/0107837 A1 4/2017 Huizenga et al.
2017/0107852 A1 * 4/2017 Nasr ..... F01D 25/12
2017/0268359 A1 9/2017 Frey
2017/0314414 A1 11/2017 Lefebvre et al.
2017/0342910 A1 11/2017 Snider et al.
2018/0100409 A1 4/2018 Cochet et al.
2018/0238188 A1 8/2018 Shoemaker et al.
2018/0364399 A1 12/2018 Smoke et al.
2020/0025026 A1 1/2020 Packer et al.
2020/0248557 A1 * 8/2020 Snider ..... F01D 5/143
2020/0248558 A1 * 8/2020 Snider ..... F01D 25/12
2020/0248559 A1 * 8/2020 Raghavan ..... F01D 5/143

OTHER PUBLICATIONS

U.S. Appl. No. 16/263,548 Notice of Allowance dated Jul. 15, 2020, 9 pages.
U.S. Appl. No. 16/263,430, Notice of Allowance dated Sep. 23, 2020, 5 pages.

* cited by examiner

UNITARY BODY TURBINE SHROUD FOR TURBINE SYSTEMS

CROSS-REFERENCE TO RELATED APPLICATION

This application is related to co-pending U.S. application Ser. Nos. 16/263,548 and 16/263,430, filed concurrently, currently pending, and are hereby incorporated by reference in their entirety.

BACKGROUND OF THE INVENTION

The disclosure relates generally to a turbine system component, and more particularly, to a unitary body turbine shroud for turbine systems.

Conventional turbomachines, such as gas turbine systems, generate power for electric generators. In general, gas turbine systems generate power by passing a fluid (e.g., hot gas) through a turbine component of the gas turbine system. More specifically, inlet air may be drawn into a compressor to be compressed. Once compressed, the inlet air is mixed with fuel to form a combustion product, which may be reacted by a combustor of the gas turbine system to form the operational fluid (e.g., hot gas) of the gas turbine system. The fluid may then flow through a fluid flow path for rotating a plurality of rotating blades and rotor or shaft of the turbine component for generating the power. The fluid may be directed through the turbine component via the plurality of rotating blades and a plurality of stationary nozzles or vanes positioned between the rotating blades. As the plurality of rotating blades rotate the rotor of the gas turbine system, a generator, coupled to the rotor, may generate power from the rotation of the rotor.

To improve operational efficiencies turbine components may include hot gas path components, such as turbine shrouds and/or nozzle bands, to further define the flow path of the operational fluid. Turbine shrouds, for example, may be positioned radially adjacent rotating blades of the turbine component and may direct the operational fluid within the turbine component and/or define the outer bounds of the fluid flow path for the operational fluid. During operation, turbine shrouds may be exposed to high temperature operational fluids flowing through the turbine component. Over time and/or during exposure, the turbine shrouds may undergo undesirable thermal expansion. The thermal expansion of turbine shrouds may result in damage to the shrouds and/or may not allow the shrouds to maintain a seal within the turbine component for defining the fluid flow path for the operational fluid. When the turbine shrouds become damaged or no longer form a satisfactory seal within the turbine component, the operational fluid may leak from the flow path, which in turn reduces the operational efficiency of the turbine component and the entire turbine system.

To minimize thermal expansion, turbine shrouds are typically cooled. Conventional processes for cooling turbine shrouds include film cooling and impingement cooling. Film cooling involves the process of flowing cooling air over the surfaces of the turbine shroud during operation of the turbine component. Impingement cooling utilizes holes or apertures formed through the turbine shroud to provide cooling air to various portions of the turbine shroud during operation.

Each of these cooling processes create issues during operation of the turbine component. For example, the cooling air utilized in film cooling may mix with the operational fluid flowing through the fluid flow path, and may cause turbulence within the turbine component. Additionally, turbine shrouds often have patterned surfaces that may improve sealing with the rotor during operation. However, the patterned surfaces are not usually conducive with film cooling processes for cooling the shroud. With respect to impingement cooling, in order to form impingement holes or apertures through various portions of the turbine shroud, the turbine shroud must be formed from multiple pieces that must be assembled and/or secured together prior to being installed into the turbine component. As the number of pieces assembled to form the turbine shroud increases, so may the likelihood of possible uncoupling and/or damage to the turbine shroud and/or the turbine component.

BRIEF DESCRIPTION OF THE INVENTION

A first aspect of the disclosure provides a turbine shroud for a turbine system. The turbine shroud includes: a unitary body including: a support portion coupled directly to a turbine casing of the turbine system, the support portion including a forward end, an aft end positioned opposite the forward end, a first surface formed between the forward end and the aft end, and a second surface formed between the forward end and the aft end, opposite the first surface; at least one forward hook formed integral with the forward end of the support portion, the at least one forward hook extending adjacent the first surface of the support portion; at least one aft hook formed integral with the aft end of the support portion, the at least one aft hook extending adjacent the first surface of the support portion; an intermediate portion integral with and extending away from the second surface of the support portion, the intermediate portion including: an aft segment extending perpendicularly away from the second surface of the support portion, a non-linear segment extending away from the second surface of the support portion, adjacent the aft segment, the non-linear segment including: a first end formed integral with the second surface of the support portion between the forward end and the aft end, a second end positioned opposite the first end, the second end positioned axially upstream of the at least one forward hook, a curved section extending between the first end and the second end, and a forward segment formed integral with the second end of the non-linear segment, the forward segment positioned axially upstream of the at least one forward hook; and a seal portion integral with the intermediate portion, opposite the support portion, the seal portion including: a forward end formed integral with the forward segment of the intermediate portion, the forward end positioned axially upstream of the at least one forward hook, an aft end positioned opposite the forward end, the aft end formed integral with the aft segment of the intermediate portion, and a hot gas path (HGP) surface extending between the forward end and aft end, the HGP surface positioned adjacent a hot gas flow path for the turbine system.

A second aspect of the disclosure provides a turbine system including: a turbine casing; a rotor extending axially through the turbine casing a plurality of turbine blades positioned circumferentially about and extending radially from the rotor; and a plurality of turbine shrouds directly coupled to the turbine casing and positioned radially between the turbine casing and the plurality of turbine blades, each of the plurality of turbine shrouds including: a unitary body including: a support portion coupled directly to the turbine casing, the support portion including a forward end, an aft end positioned opposite the forward end, a first surface formed between the forward end and the aft end, and a second surface formed between the forward end and the aft end, opposite the first surface; at least one forward hook formed integral with the forward end of the support portion, the at least one forward hook extending adjacent the first surface of the support portion; at least one aft hook formed integral with the aft end of the support portion, the at least one aft hook extending adjacent the first surface of the support portion; an intermediate portion integral with and extending radially from the second surface of the support portion, the intermediate portion including: an aft segment extending radially from the second surface of the support portion, a non-linear segment extending away from the second surface of the support portion, adjacent the aft segment, the non-linear segment including: a first end formed integral with the second surface of the support portion between the forward end and the aft end, a second end positioned opposite the first end, the second end positioned axially upstream of the at least one forward hook, a curved section extending between the first end and the second end, and a forward segment formed integral with the second end of the non-linear segment, the forward segment positioned axially upstream of the at least one forward hook; and a seal portion integral with the intermediate portion, radially opposite the support portion, the seal portion including: a forward end formed integral with the forward segment of the intermediate portion, the forward end positioned axially upstream of the at least one forward hook, an aft end positioned opposite the forward end, the aft end formed integral with the aft segment of the intermediate portion, and a hot gas path (HGP) surface extending between the forward end and aft end, the HGP surface positioned adjacent a hot gas flow path for the turbine system.

The illustrative aspects of the present disclosure are designed to solve the problems herein described and/or other problems not discussed.

BRIEF DESCRIPTION OF THE DRAWINGS

These and other features of this disclosure will be more readily understood from the following detailed description of the various aspects of the disclosure taken in conjunction with the accompanying drawings that depict various embodiments of the disclosure, in which.

It is noted that the drawings of the disclosure are not to scale. The drawings are intended to depict only typical aspects of the disclosure, and therefore should not be considered as limiting the scope of the disclosure. In the drawings, like numbering represents like elements between the drawings.

DETAILED DESCRIPTION OF THE INVENTION

Figure 1:
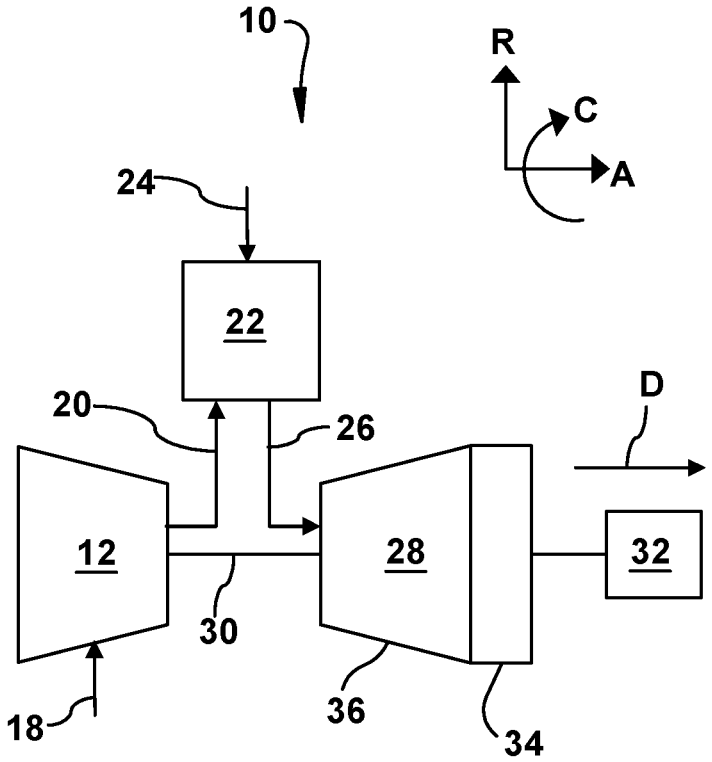
FIG. 1 shows a schematic diagram of a gas turbine system, according to embodiments of the disclosure.

As an initial matter, in order to clearly describe the current disclosure it will become necessary to select certain terminology when referring to and describing relevant machine components within the scope of this disclosure. When doing this, if possible, common industry terminology will be used and employed in a manner consistent with its accepted meaning. Unless otherwise stated, such terminology should be given a broad interpretation consistent with the context of the present application and the scope of the appended claims. Those of ordinary skill in the art will appreciate that often a particular component may be referred to using several different or overlapping terms. What may be described herein as being a single part may include and be referenced in another context as consisting of multiple components. Alternatively, what may be described herein as including multiple components may be referred to elsewhere as a single part.

In addition, several descriptive terms may be used regularly herein, and it should prove helpful to define these terms at the onset of this section. These terms and their definitions, unless stated otherwise, are as follows. As used herein, "downstream" and "upstream" are terms that indicate a direction relative to the flow of a fluid, such as the working fluid through the turbine engine or, for example, the flow of air through the combustor or coolant through one of the turbine's component systems. The term "downstream" corresponds to the direction of flow of the fluid, and the term "upstream" refers to the direction opposite to the flow. The terms "forward" and "aft," without any further specificity, refer to directions, with "forward" referring to the front or compressor end of the engine, and "aft" referring to the rearward or turbine end of the engine. Additionally, the terms "leading" and "trailing" may be used and/or understood as being similar in description as the terms "forward" and "aft," respectively. It is often required to describe parts that are at differing radial, axial and/or circumferential positions. The "A" axis represents an axial orientation. As used herein, the terms "axial" and/or "axially" refer to the relative position/direction of objects along axis A, which is substantially parallel with the axis of rotation of the turbine system (in particular, the rotor section). As further used herein, the terms "radial" and/or "radially" refer to the relative position/direction of objects along a direction "R" (see, FIGS. 1 and 2), which is substantially perpendicular with axis A and intersects axis A at only one location. Finally, the term "circumferential" refers to movement or position around axis A (e.g., direction "C").

As indicated above, the disclosure relates generally to a turbine system component, and more particularly, to a unitary body turbine shroud for turbine systems.

These and other embodiments are discussed below with reference to FIGS. 1-10. However, those skilled in the art will readily appreciate that the detailed description given herein with respect to these Figures is for explanatory purposes only and should not be construed as limiting.

FIG. 1 shows a schematic view of an illustrative gas turbine system 10. Gas turbine system 10 may include a compressor 12. Compressor 12 compresses an incoming flow of air 18. Compressor 12 delivers a flow of compressed air 20 to a combustor 22. Combustor 22 mixes the flow of compressed air 20 with a pressurized flow of fuel 24 and ignites the mixture to create a flow of combustion gases 26. Although only a single combustor 22 is shown, gas turbine system 10 may include any number of combustors 22. The flow of combustion gases 26 is in turn delivered to a turbine 28, which typically includes a plurality of turbine blades including airfoils (see, FIG. 2) and stator vanes (see, FIG. 2). The flow of combustion gases 26 drives turbine 28, and more specifically the plurality of turbine blades of turbine 28, to produce mechanical work. The mechanical work produced in turbine 28 drives compressor 12 via a rotor 30 extending through turbine 28, and may be used to drive an external load 32, such as an electrical generator and/or the like.

Gas turbine system 10 may also include an exhaust frame 34. As shown in FIG. 1, exhaust frame 34 may be positioned adjacent to turbine 28 of gas turbine system 10. More specifically, exhaust frame 34 may be positioned adjacent to turbine 28 and may be positioned substantially downstream of turbine 28 and/or the flow of combustion gases 26 flowing from combustor 22 to turbine 28. As discussed herein, a portion (e.g., outer casing) of exhaust frame 34 may be coupled directly to an enclosure, shell, or casing 36 of turbine 28.

Subsequent to combustion gases 26 flowing through and driving turbine 28, combustion gases 26 may be exhausted, flow-through and/or discharged through exhaust frame 34 in a flow direction (D). In the non-limiting example shown in FIG. 1, combustion gases 26 may flow through exhaust frame 34 in the flow direction (D) and may be discharged from gas turbine system 10 (e.g., to the atmosphere). In another non-limiting example where gas turbine system 10 is part of a combined cycle power plant (e.g., including gas turbine system and a steam turbine system), combustion gases 26 may discharge from exhaust frame 34, and may flow in the flow direction (D) into a heat recovery steam generator of the combined cycle power plant.

Figure 2:
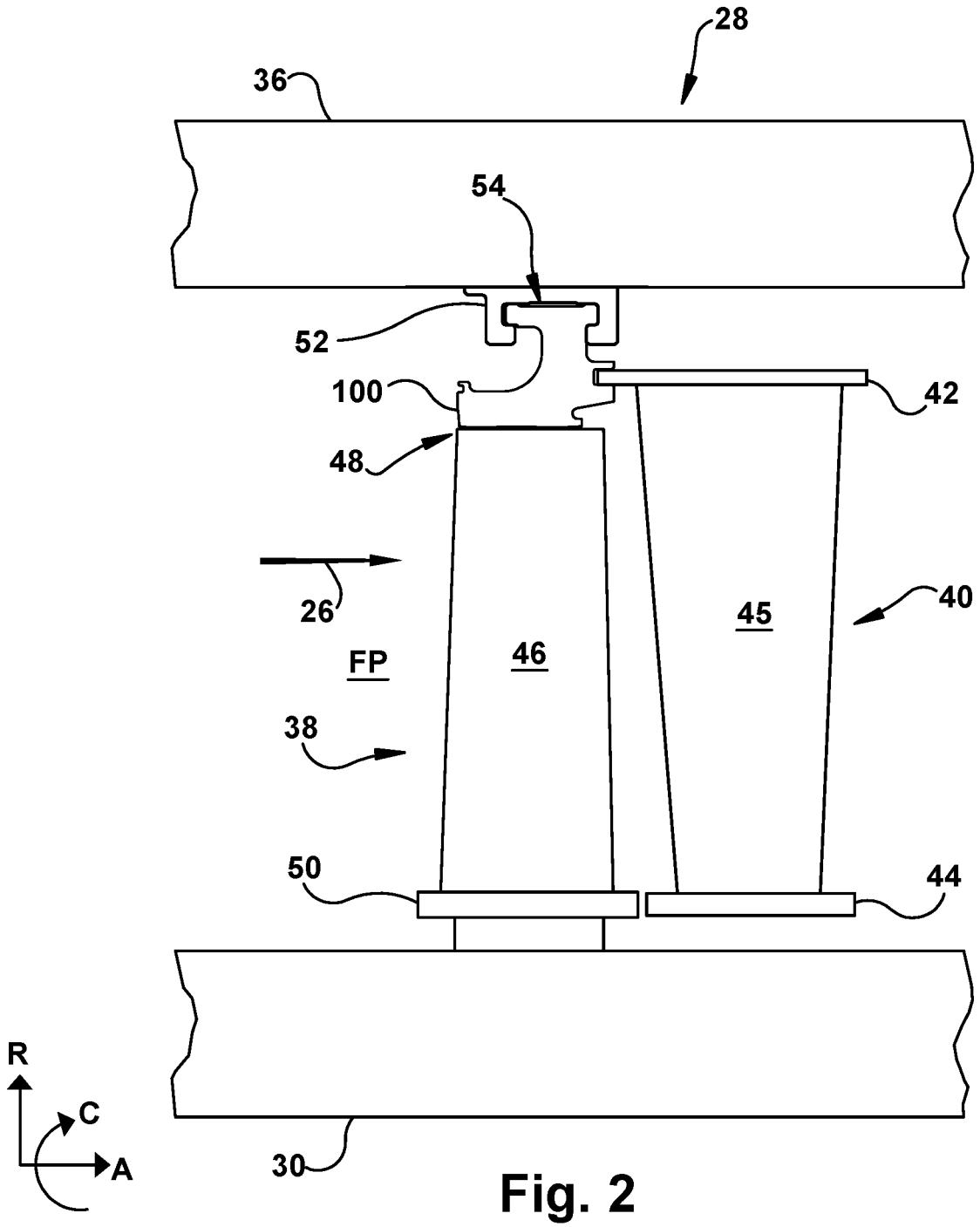
FIG. 2 shows a side view of a portion of a turbine of the gas turbine system of FIG. 1 including a turbine blade, a stator vane, a rotor, a turbine casing, and a turbine shroud, according to embodiments of the disclosure.

Turning to FIG. 2, a portion of turbine 28 is shown. Specifically, FIG. 2 shows a side view of a portion of turbine 28 including a stage of turbine blades 38 (one shown), and a stage of stator vanes 40 (one shown) positioned within casing 36 of turbine 28. As discussed herein, each stage (e.g., first stage, second stage (not shown), third stage (not shown)) of turbine blades 38 may include a plurality of turbine blades 38 that may be coupled to and positioned circumferentially around or about rotor 30 and may be driven by combustion gases 26 to rotate rotor 30. As show, the plurality of turbine blades 38 may also extend radially from rotor 30. Additionally, each stage (e.g., first stage, second stage (not shown), third stage (not shown)) of stator vanes 40 may include a plurality of stator vanes that may be coupled to and/or positioned circumferentially about casing 36 of turbine 28. In the non-limiting example shown in FIG. 2, stator vanes 40 may include a plurality of hot gas path (HGP) components including and/or be formed as an outer platform 42, and an inner platform 44 positioned opposite the outer platform 42. Stator vanes 40 of turbine 28 may also include an airfoil 45 positioned between outer platform 42 and inner platform 44. Outer platform 42 and inner platform 44 of stator vanes 40 may define a flow path (FP) for the combustion gases 26 flowing over stator vanes 40. As discussed herein, stator vanes 40 may be coupled to adjacent and/or surrounding turbine shrouds of turbine 28.

Each turbine blade 38 of turbine 28 may include an airfoil 46 extending radially from rotor 30 and positioned within the flow path (FP) of combustion gases 26 flowing through turbine 28. Each airfoil 46 may include tip portion 48 positioned radially opposite rotor 30. Turbine blade 38 may also include a platform 50 positioned opposite tip portion 48 of airfoil 46. In a non-limiting example, platform 50 may partially define a flow path for combustion gases 26 for turbine blades 38. Turbine blades 38 and stator vanes 40 may also be positioned axially adjacent to one another within casing 36. In the non-limiting example shown in FIG. 2, stator vanes 40 may be positioned axially adjacent and downstream of turbine blades 38. Not all turbine blades 38, stator vanes 40 and/or all of rotor 30 of turbine 28 are shown for clarity. Additionally, although only a portion of a single stage of turbine blades 38 and stator vanes 40 of turbine 28 are shown in FIG. 2, turbine 28 may include a plurality of stages of turbine blades and stator vanes, positioned axially throughout casing 36 of turbine 28.

Turbine 28 of gas turbine system 10 (see, FIG. 1) may also include a plurality of turbine shrouds 100 included within turbine 28. Turbine 28 may include a stage of turbine shrouds 100 (one shown). Turbine shrouds 100 may correspond with the stage of turbine blades 38 and/or the stage of stator vanes 40. That is, and as discussed herein, the stage of turbine shrouds 100 may be positioned within turbine 28 adjacent the stage of turbine blades 38 and/or the stage of stator vanes 40 to interact with and provide a seal in and/or define the flow path (FP) of combustion gases 26 flowing through turbine 28. In the non-limiting example shown in FIG. 2, the stage of turbine shrouds 100 may be positioned radially adjacent and/or may substantially surround or encircle the stage of turbine blades 38. Turbine shrouds 100 may be positioned radially adjacent tip portion 48 of airfoil 46 for turbine blade 38. Additionally in the non-limiting example, turbine shrouds 100 may also be positioned axially adjacent and/or upstream of stator vanes 40 of turbine 28. As discussed herein (see, FIG. 8), turbine shrouds 100 may be positioned between two adjacent stages of stator vanes that may surround and/or be positioned on either axially side of a single stage of turbine blades.

The stage of turbine shrouds may include a plurality of turbine shrouds 100 that may be coupled directly to and/or positioned circumferentially about casing 36 of turbine 28. In the non-limiting example shown in FIG. 2, turbine shrouds 100 may be coupled directly to casing 36 via extension 52 extending radially inward (e.g., toward rotor 30) from casing 36 of turbine 28. As discussed herein, extension 52 may include an opening 54 that may be configured to be coupled to and/or receive fasteners or hooks (see, FIG. 8) of turbine shrouds 100 to couple, position, and/or secure turbine shrouds 100 to casing 36 of turbine 28. In a non-limiting example, extension 52 may be coupled and/or fixed to casing 36 of turbine 28. More specifically, extension 52 may be circumferentially disposed around casing 36, and may be positioned radially adjacent turbine blades 38. In another non-limiting example, extension 52 may be formed integral with casing 36 for coupling, positioning, and/or securing turbine shrouds 100 directly to casing 36. Similar to turbine blades 38 and/or stator vanes 40, although only a portion of the stage of turbine shrouds 100 of turbine 28 is shown in FIG. 2, turbine 28 may include a plurality of stages of turbine shrouds 100, positioned axially throughout casing 36 of turbine 28 and coupled to casing 26 using extension 52.

Figure 3:
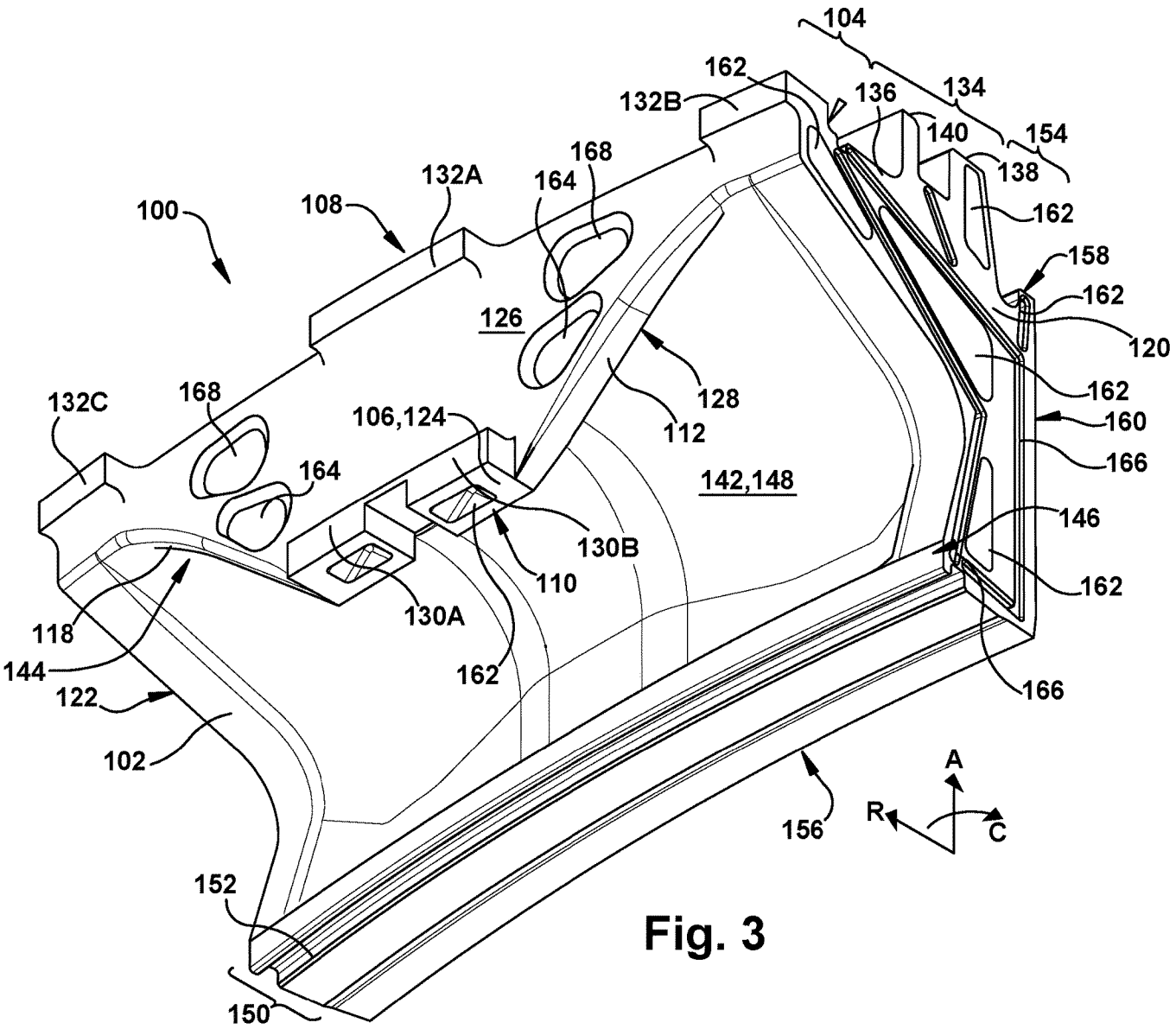
FIG. 3 shows perspective view of the turbine shroud of FIG. 2, according to embodiments of the disclosure.
Figure 4:
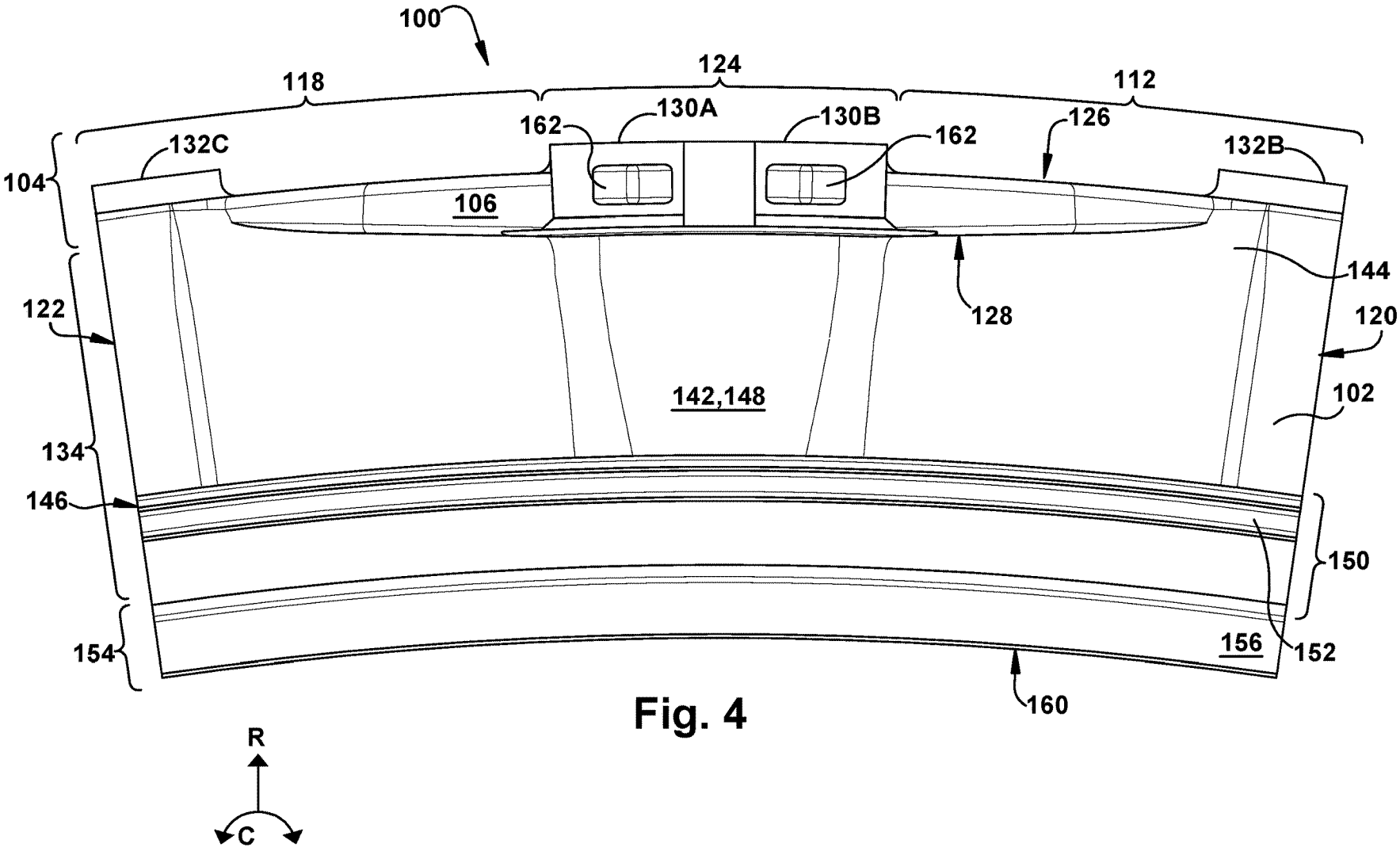
FIG. 4 shows a front view of the turbine shroud of FIG. 3, according to embodiments of the disclosure.
Figure 5:
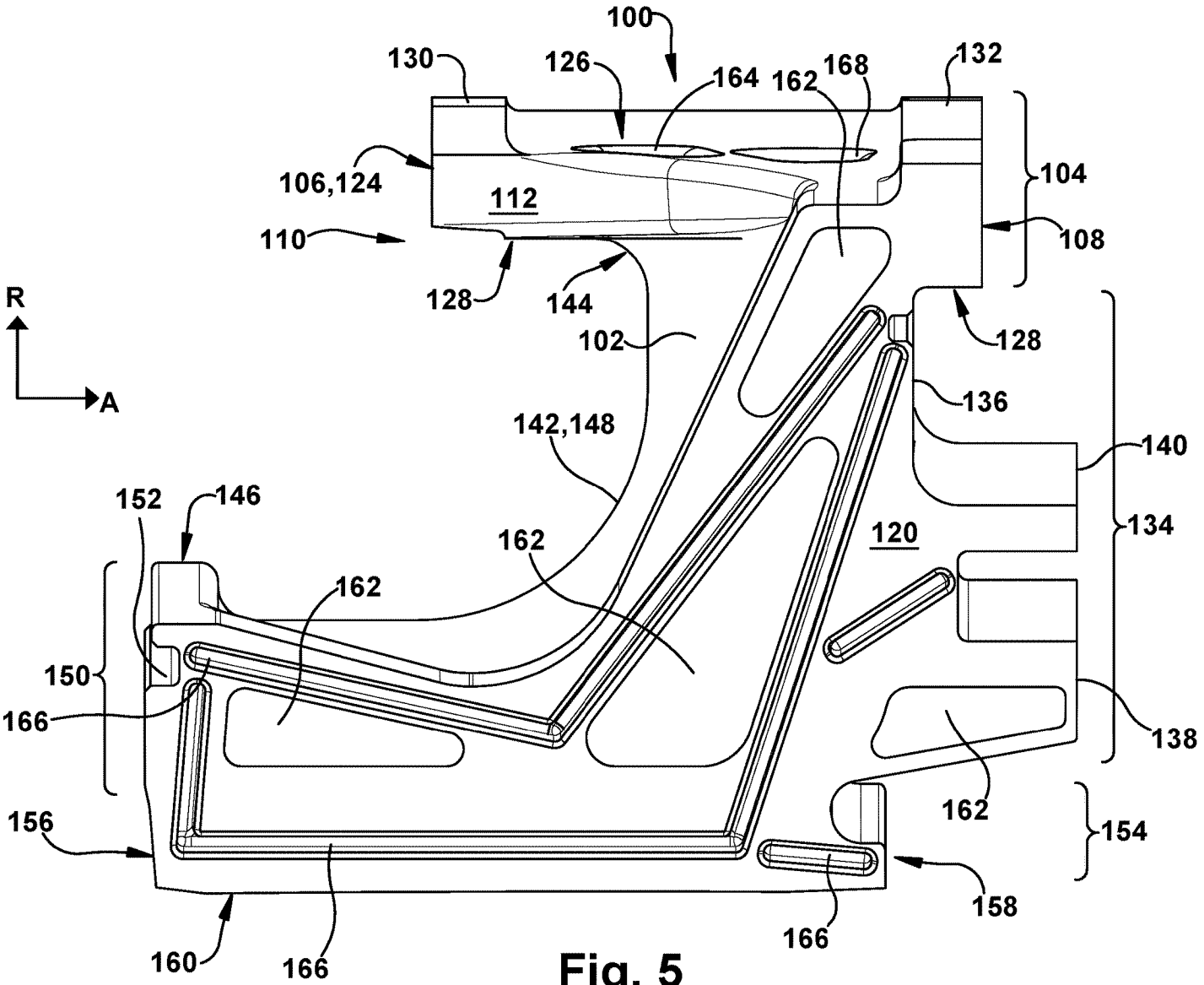
FIG. 5 shows a first side view of the turbine shroud of FIG. 3, according to embodiments of the disclosure.
Figure 6:
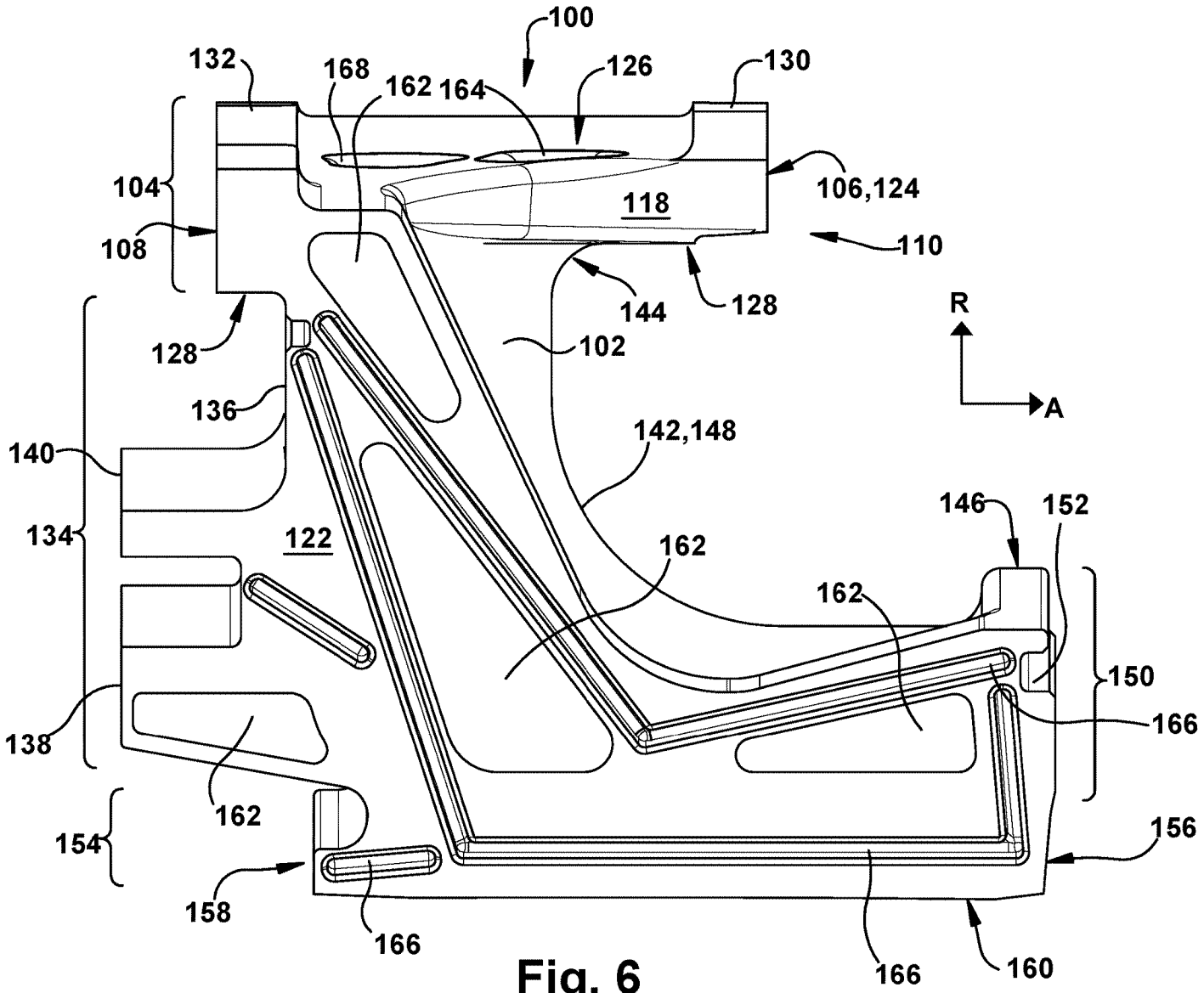
FIG. 6 shows a second side view of the turbine shroud of FIG. 3, according to embodiments of the disclosure.
Figure 7:
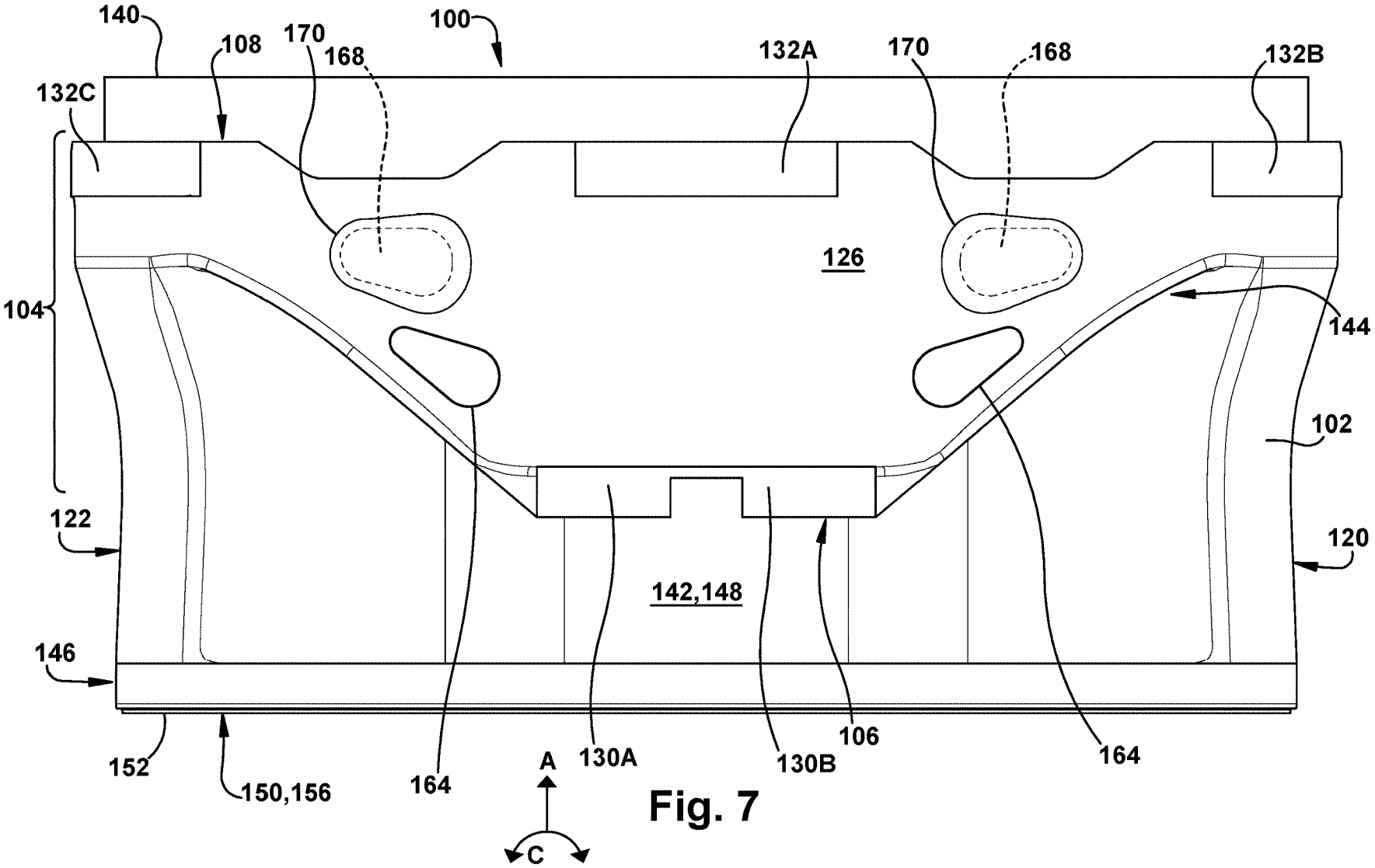
FIG. 7 shows a top view of the turbine shroud of FIG. 3, according to embodiments of the disclosure.

FIGS. 3-7 show various views of turbine shroud 100 of turbine 28 for gas turbine system 10 of FIG. 1. Specifically, FIG. 3 shows an isometric view of turbine shroud 100, FIG. 4 shows a front view of turbine shroud 100, FIG. 5 shows a first side view of turbine shroud 100, FIG. 6 shows a second view of turbine shroud 100, and FIG. 7 shows a top view of turbine shroud 100.

The non-limiting example of turbine shroud 100, and its various components, may be addressed herein with reference to all of FIGS. 3-7 to ensure that each of the plurality of components are adequately and accurately described and shown. When applicable, specific figures of the collective FIGS. 3-7 may be referenced when discussing a component(s) or feature of turbine shroud 100. Additionally, several reference lines or directions shown in FIGS. 1 and 2 may be used regularly herein, with respect to FIGS. 3 and 7. For example in each of FIGS. 3-7, "A" may refer represent an axial orientation or axis, "R" may refer to a radial axis substantially perpendicular with axis A, and "C" may refer to a circumferential direction, movement, and/or position along a path centric about axis "A," as discussed herein.

Turbine shroud 100 may include a body 102. In the non-limiting example shown in FIGS. 3-7, turbine shroud 100 may include and/or be formed as a unitary body 102 such that turbine shroud 100 is a single, continuous, and/or non-disjointed component or part. In the non-limiting example shown in FIGS. 3-7, because turbine shroud 100 includes unitary body 102, turbine shroud 100 may not require the building, joining, coupling, and/or assembling of various parts to completely form turbine shroud 100, and/or may not require building, joining, coupling, and/or assembling of various parts before turbine shroud 100 can be installed and/or implemented within turbine system 10 (see, FIG. 1). Rather, once single, continuous, and/or non-disjointed unitary body 102 for turbine shroud 100 is built, as discussed herein, turbine shroud 100 may be immediately installed within turbine system 10.

In the non-limiting example, unitary body 102 of turbine shroud 100, and the various components and/or features of turbine shroud 100, may be formed using any suitable additive manufacturing process and/or method. For example, turbine shroud 100 including unitary body 102 may be formed by direct metal laser melting (DMLM) (also referred to as selective laser melting (SLM)), direct metal laser sintering (DMLS), electronic beam melting (EBM), stereolithography (SLA), binder jetting, or any other suitable additive manufacturing process. As such, unitary body 102 of turbine shroud 100, and the various components and/or features integrally formed on/in unitary body 102 of turbine shroud 100, may be formed during a single, additive manufacturing process and/or method. Additionally, unitary body 102 of turbine shroud 100 may be formed from any material that may be utilized by additive manufacturing process(es) to form turbine shroud 100, and/or capable of withstanding the operational characteristics (e.g., exposure temperature, exposure pressure, and the like) experienced by turbine shroud 100 within gas turbine system 10 during operation.

As a result of being formed from unitary body 102, turbine shroud 100 may include various integrally formed portions that each may include different features, components, and/or segments that may provide a seal in and/or define the flow path (FP) of combustion gases 26 flowing through turbine 28 (see, FIG. 2). That is, and because turbine shroud 100 includes unitary body 102 formed using any suitable (single) additive manufacturing process and/or method, the features, components, and/or segments of turbine shroud 100 may be formed integrally with unitary body 102. The terms "integral features" or "integrally formed features" may refer to features formed on or in unitary body 102 during the (single) additive manufacturing process, features formed from the same material as unitary body 102, and/or features formed on or in unitary body 102 such that the features are not fabricated using distinct process(es) and/or raw material components that are separately and subsequently built, joined, coupled, and/or assembled on or in unitary body 102 of turbine shroud 100.

For example, turbine shroud 100 may include a support portion 104. As discussed herein, support portion 104, and features formed thereon, may be coupled directly to and/or aid in the coupling of turbine shroud 100 to turbine casing 36 and/or extension 52 (see, FIG. 8). Support portion 104 of unitary body 102 may include a forward end 106, and an aft end 108 positioned the forward end 106. Forward end 106 may be positioned axially upstream of aft end 108.

In the non-limiting example shown in FIGS. 3, 4, and 7 forward end 106 may include a protruding and/or converging shape, orientation, and/or configuration 110 (hereafter, "configuration 110"). That is, and as shown in the non-limiting example, forward end 106 of support portion 104 may be formed to have and/or include configuration 110 that may include opposing angular and/or curved walls 112, 118 that extend axially from opposing sides or slash faces 120, 122 of unitary body 102 and converge on a central wall 124. Central wall 124 of forward end 106 may be positioned and/or formed upstream of walls 112, 118, and/or may be positioned axially forward of the remaining portions of support portion 104 of unitary body 102. That is, central wall 124 may be the axially-forward most portion of forward end 106 of support portion 104 for unitary body 102.

Additionally, support portion 104 may also include a first surface 126, and a second surface 128. First surface 126 and second surface 128 may extend (axially) between forward end 106 and aft end 108. Additionally, first surface 126 and second surface 128 may be formed or extend substantially perpendicular to forward end 106 and/or aft end 108 of support portion 104. As shown in the non-limiting example, second surface 128 of support portion 104 may be positioned and/or formed (radially) opposite first surface 110.

Figure 8:
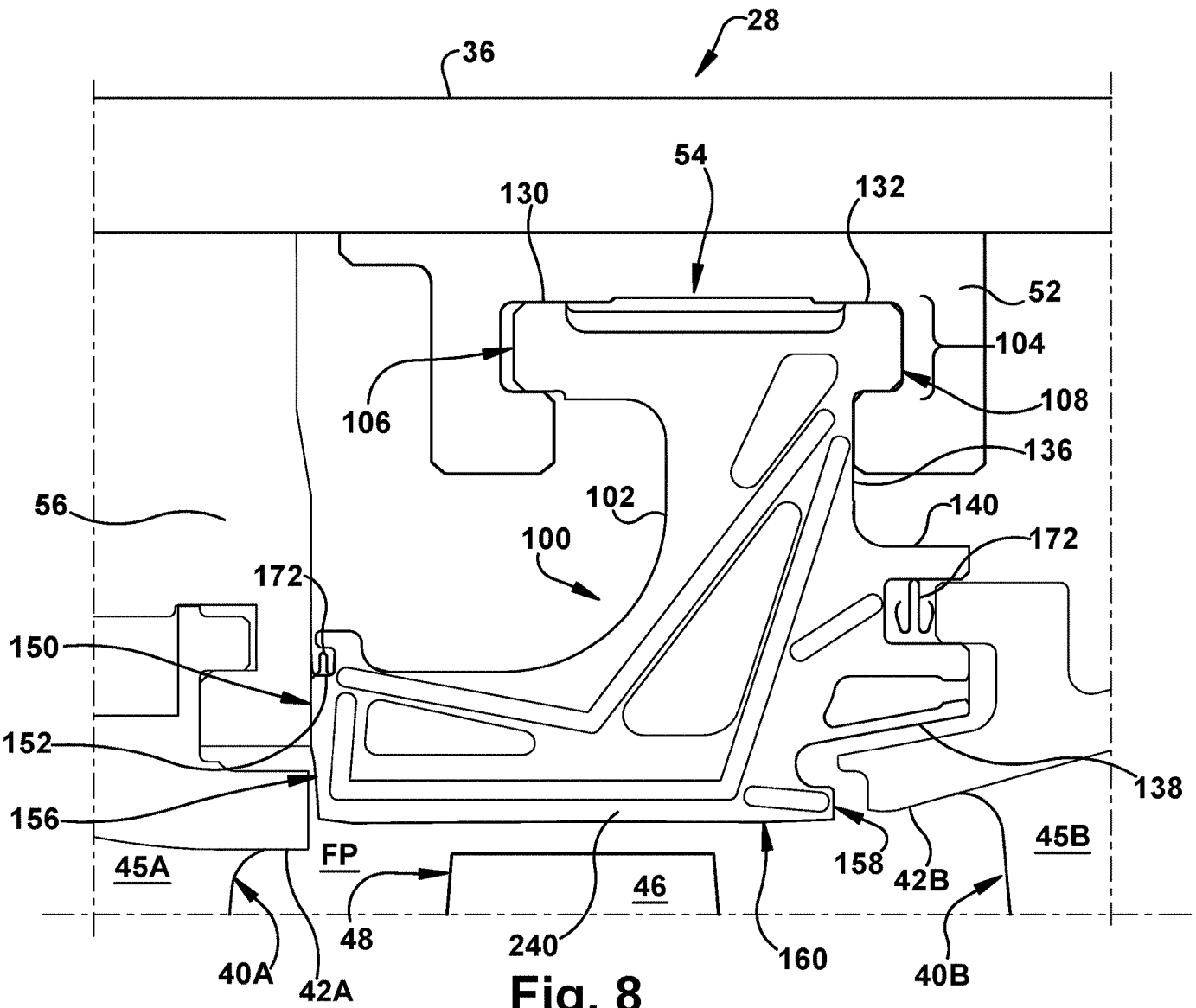
FIG. 8 shows an enlarged side view of a portion of the gas turbine system of FIG. 2 including the turbine shroud of FIG. 3, according to embodiments of the disclosure.

Unitary body 102 for turbine shroud 100 may also include a plurality of hooks for coupling turbine shroud 100 to turbine casing 36 and/or extension 52 (see, FIG. 8). As shown in FIGS. 3-7, unitary body 102 may include at least one forward hook 130, and at least one aft hook 132. Forward hook(s) 130 and aft hook(s) 132 may be formed integral with support portion 104 of unitary body 102. More specifically, forward hook(s) 130 may be formed integral with forward end 106 of support portion 104, and aft hook(s) 132 may be formed integral with aft end 108 of support portion 104, (axially) opposite forward hook(s) 130. Additionally as shown in FIGS. 3-6, forward hook(s) 130 and aft hook(s) 132 may also extend (radially) adjacent first surface 126 of support portion 104. That is, forward hook(s) 130 and aft hook(s) 132 formed integral with forward end 106 and aft end 108, respectively, may extend radially adjacent, and more specifically radially outward, first surface 126 of support portion 104.

In the non-limiting example shown in FIGS. 3-7, unitary body 102 of turbine shroud 100 may include two forward hooks 130A, 130B. Two forward hooks 130A, 130B may be formed integral with and centrally positioned on forward end 106 of support portion 104, between first slash face 120 and second slash face 122 of unitary body 102. More specifically, two forward hooks 130A, 130B may be formed integrally with central wall 124 of forward end 106 of support portion 104. Additionally, and as shown in the non-limiting example, two forward hooks 130A, 130B may be formed (circumferentially) between walls 112, 118 of forward end 106 of support portion 104.

Additionally in the non-limiting example shown in FIGS. 3-7, unitary body 102 of turbine shroud 100 may include three distinct aft hooks 132A, 132B, 132C. Three aft hooks 132A, 132B, 132C may be formed integral with aft end 108 of support portion 104, between first slash face 120 and second slash face 122 of unitary body 102. For example, a first aft hook 132A may be formed integral with and centrally position on aft end 108 of support portion 104, between slash face 120 and second slash face 122 of unitary body 102. In the non-limiting example, first aft hook 132A may be formed on aft end 108 of support portion 104 axially opposite and/or in axial alignment with two forward hooks 130A, 130B formed on first end 106 of support portion 104. Additionally, a second aft hook 132B may be formed integral with aft end 108 of support portion 104, directly adjacent first slash face 120 of unitary body 102. A third aft hook 132C may be formed integral with aft end 108 of support portion 104, directly adjacent second slash face 122 of unitary body 102. Third aft hook 132C may be formed on support portion 104 circumferentially opposite second aft hook 132B.

It is understood that the size, shape, and/or number of hooks 130, 132 included in turbine shroud 100, as shown in FIGS. 3-7, is merely illustrative. As such, turbine shroud 100 may include more or less, larger or smaller, and/or distinctly shaped hooks 130, 132 formed therein. The size, shapes, and/or number of hooks 130, 132 included in turbine shroud 100 may depend at least in part on various parameters (e.g., exposure temperature, exposure pressure, position within turbine casing 36, associated turbine blade 38 stage, size or shape of extension 52, size or shape of opening 54, and the like) of gas turbine system 10 during operation. Additionally, or alternatively, the size, shapes, and/or number of hooks 130, 132 included in turbine shroud 100 may be dependent, at least in part on the characteristics (e.g., size or shape of support portion 104) of turbine shroud 100.

In the non-limiting example shown in FIGS. 3-7, unitary body 102 of turbine shroud 100 may also include intermediate portion 134. Intermediate portion 134 may be formed integral with and extending from support portion 104. More specifically, intermediate portion 134 of unitary body 102 may be formed integral with and may extend radially away from second surface 128 of support portion 104. In the non-limiting example, intermediate portion 134 of turbine shroud 100 may be positioned radially between support portion 104 of unitary body 102 and turbine blade 38 of turbine 28 (see, FIG. 8).

Intermediate portion 134 may include various features and/or segments of unitary body 102 for turbine shroud 100. The various features and/or segments discussed herein may extend and/or be formed between opposing slash faces 120, 122 of unitary body 102. For example, intermediate portion 134 may include an aft segment 136 extending perpendicularly and/or radially away from second surface 128 of support portion 104. Additionally as shown in FIGS. 3, 5, and 6, aft segment 136 of intermediate portion 134 may be extending from second surface 128 substantially adjacent aft end 108 of support portion 104 and/or aft hook(s) 132 of unitary body 102. In the non-limiting example, at least a portion of aft segment 136 of intermediate portion 134 may be positioned axially upstream of aft end 108 of support portion 104 and/or aft hook(s) 132 of unitary body 102.

Aft segment 136 of intermediate portion 134 may include additional features and/or components as well. For example, and as shown in FIGS. 3, and 5-7, unitary body 102 may include at least one flange 138, 140 formed integral with and extending from aft segment 136 of intermediate portion 134. In the non-limiting example, flange(s) 138, 140 may extend across aft segment 136 of intermediate portion 134, between opposing slash faces 120, 122 of unitary body 102. Additionally as shown in FIGS. 5 and 6, flange(s) 138, 140 formed integral with aft segment 136 may extend axially beyond and/or at least partially downstream of aft end 108 of support portion 104 and/or aft hook(s) 132 of unitary body 102. As discussed herein, flange(s) 138, 140 may be used to form a seal within turbine 28, define the flow path (FP) of combustion gases 26 flowing through turbine 28, and/or may secure stator vanes 40 within casing 36 of turbine 28 (see, FIG. 8).

Intermediate portion 134 may also include a non-linear segment 142 extending away from second surface 128 of support portion 104. As shown in FIGS. 3, 5, and 6, non-linear segment 142 of intermediate portion 134 may extend substantially radially from second surface 128, between forward end 106 and aft end 108 of support portion 104 of unitary body 102, and axially adjacent aft segment 136. Non-linear segment 142 of intermediate portion 134 may include a first end 144 formed integral with second surface 128 of support portion 104 between forward end 106 and aft end 108. Additionally, non-linear segment 142 may include a second end 146 positioned opposite first end 144. Second end 146 of non-linear segment 142 may positioned radially adjacent and axially upstream of first end 144. Additionally, second end 146 of non-linear segment 142 of intermediate portion 134 may also be positioned axially upstream of forward end 106 of support portion 104, as well as forward hook(s) 130 formed integral with forward end 106 of support portion 104. A curved section 148 may extend between first end 144 and second end 146 of non-linear segment 142. That is, non-linear segment 142 may also include curved section 148 extending between first end 144 and second end 146. In the non-limiting example shown in FIGS. 3, 5, and 6, curved section 148 extending between first end 144 and second end 146 may include a substantially concave-shape or configuration, such that a side view of intermediate portion 134 and/or unitary body 102 of turbine shroud 100 may appear to be a backwards "C." As a result of extending between first end 144 and second end 146, at least a portion of curved section 148 may also be positioned or extend axially upstream of forward end 106 of support portion 104. Additionally, at least a portion of curved section 148 may be positioned or extend axially upstream of forward hook(s) 130 formed integral with forward end 106 of support portion 104.

In the non-limiting example shown in FIGS. 3-7, intermediate portion 134 of unitary body 102 may also include a forward segment 150. Forward segment 150 of intermediate portion 134 may be formed integral with second end 146 of non-linear segment 142. Additionally, forward segment 150 may be formed substantially adjacent to, perpendicular to, and/or axially upstream of second end 146 of non-linear segment 142. As shown, forward segment 150 of intermediate portion 134 may also be positioned axially upstream of forward end 106 of support portion 104, as well as forward hook(s) 130 formed integral with forward end 106 of support portion 104. Forward segment 150 of intermediate portion 134 may include a channel or shelf 152 (hereafter, "shelf 152") extending at least partially between first slash face 120 and second slash face 122 of unitary body 102. Shelf 152 may be formed and/or extend axially into forward segment 150. As discussed herein, forward segment 150 and shelf 152 may be used to form a seal within turbine 28, define the flow path (FP) of combustion gases 26 flowing through turbine 28, and/or secure stator vanes 40 within casing 36 of turbine 28 (see, FIG. 8).

Unitary body 102 of turbine shroud 100 may also include a seal portion 154. Seal portion 154 may be formed integral with intermediate portion 134. That is, seal portion 154 of unitary body 102 may be formed integral with intermediate portion 134 and may be positioned radially opposite support portion 104. In the non-limiting example, and as discussed herein seal portion 154 of turbine shroud 100 may be positioned radially between intermediate portion 134 of unitary body 102 and turbine blade 38 of turbine 28, and may at least partially define a flow path (FP) for combustion gases 26 flowing through turbine 28 (see, FIG. 8).

In the non-limiting example, seal portion 154 may include a forward end 156. Forward end 156 of seal portion 154 may be formed and/or extend between opposing slash faces 120, 122 of unitary body 102. Additionally, forward end 156 may be formed integral with, radially adjacent, and/or radially aligned with forward segment 150 of intermediate portion 134. As a result, forward end 156 may be formed substantially adjacent to, perpendicular to, and/or axially upstream of second end 146 of non-linear segment 142. Forward end 156 of seal portion 154 may also be positioned axially upstream of forward end 106 of support portion 104, as well as forward hook(s) 130 formed integral with forward end 106 of support portion 104. Because unitary body 102 includes support 104 and intermediate portion 134 having non-linear segment 142, as discussed herein, forward end 156 of seal portion 154 may be positioned axially upstream of support portion 104 in a substantially cantilever manner or fashion without being directly coupled or connected to, and/or being formed integral with support portion 104. As a result, forward end 156, as well as other portions of seal portion 154, may thermally expand during operation of turbine 28 without causing undesirable mechanical stress or strain on other portions (e.g., support portion 104, intermediate portion 134) of turbine shroud 100.

Seal portion 154 may also include an aft end 158 positioned and/or formed opposite of forward end 156. Aft end 158 may also be positioned downstream of forward end 156, such that combustion gases 26 flowing through the flow path (FP) defined within turbine 28 may flow adjacent forward end 156 before flowing by adjacent aft end 158 of seal portion 154 for unitary body 102 of turbine shroud 100. Aft end 158 of seal portion 154 may be formed integral with, radially adjacent, and/or radially aligned with aft segment 136 of intermediate portion 134.

In the non-limiting example shown in FIGS. 3-7, seal portion 154 may also include a hot gas path (HGP) surface 160. HGP surface 160 of seal portion 154 may be integrally formed and/or extend axially between forward end 156 and aft end 158. Additionally, HGP surface 160 of seal portion 154 may be integrally formed and/or extend circumferentially between opposing slash faces 120, 122 of unitary body 102. HGP surface 160 may also be formed radially opposite first surface 126 of support portion 104 of unitary body 102. As discussed herein, HGP surface 160 may be positioned adjacent a hot gas flow path (FP) of combustion gases 26 of turbine 28. That is, and as discussed herein with respect to FIG. 8, HGP surface 160 may be positioned, formed, face, and/or directly exposed to the hot gas flow path (FP) of combustion gases 26 flowing through turbine casing 36 of turbine 28 for gas turbine system 10 (see, FIG. 2). Additionally when included in turbine casing 36, HGP surface 160 of unitary body 102 for turbine shroud 100 may be positioned radially adjacent tip portion 48 of airfoil 46 (see, FIG. 8).

As discussed herein, unitary body 102 of turbine shroud 100 may include first slash face 120 and second slash face 122. As shown in the non-limiting example of FIGS. 5 and 6, opposing slash faces 120, 122 of unitary body 102 may form side walls extending radially over unitary body 102 of turbine shroud 100. More specifically, first slash face 120 may extend adjacent to and radially between first surface 126 of support portion 104 and HGP surface 160 of seal portion 154, and second slash face 122 may extend adjacent to and radially between first surface 126 of support portion 104 and HGP surface 160 of seal portion 154, circumferentially opposite first slash face 120. As such, slash faces 120, 122 may extend over the various portions forming unitary body 102. Slash faces 120, 122 specifically may extend over support portion 104, intermediate portion 134, and/or seal portion 154, to form circumferential boundaries, side walls and/or side surfaces for unitary body 102.

Turbine shroud 100 may also include a plurality of features to reduce overall weight and/or material requirement for forming turbine shroud 100 from unitary body 102. For example, at least one cavity 162 may be formed on first slash face 120 and/or second slash face 122 of unitary body 102. More specifically, and as shown in FIGS. 3, 5, and 6, at least one cavity 162 may be formed on and/or may extend over at least a portion of slash faces 120, 122, between first surface 126 of support portion 104 and HGP surface 160 of seal portion 154. In the non-limiting example, cavities 162 may be formed on and/or extend over slash faces 120, 122 in circumferential and/or radial alignment with at least a portion of support portion 104, intermediate portion 134, and seal portion 154. Additionally, and as shown, cavities 162 may be formed on and/or extend over additional features of unitary body 102, for instance flange 138 formed integral with aft segment 136 of intermediate portion 134. The at least one cavity 162 formed on slash faces 120, 122 may not extend through any portion of unitary body 102 for turbine shroud 100, and/or may not be in fluid communication with any internal features (e.g., cooling circuits) formed in turbine shroud 100. Rather, the at least one cavity 162 may be formed as hollows, voids, depression, dimples, and/or indentions in slash faces 120, 122. The inclusion of cavity 162 in slash faces 120, 122 may reduce the weight the of turbine shroud 100, add flexibility to turbine shroud 100, and/or reduce the material (and in turn manufacturing cost) required to build or additively manufacture turbine shroud 100.

It is understood that the size, shape, and/or number of cavities 162 included in turbine shroud 100, as shown in FIGS. 3, 5, and 6, are merely illustrative. As such, turbine shroud 100 may include more or fewer, larger or smaller, and/or distinctly shaped cavities 162 formed therein. The size, shapes, and/or number of cavities 162 included in turbine shroud 100 may depend at least in part on various parameters (e.g., exposure temperature, exposure pressure, position within turbine casing 36, associated turbine blade 38 stage, size or shape of extension 52, size or shape of opening 54, and the like) of gas turbine system 10 during operation. Additionally, or alternatively, the size, shapes, and/or number of cavities 162 included in turbine shroud 100 may depend, at least in part on the characteristics (e.g., size or shape of unitary body 102) of turbine shroud 100.

Additionally, although shown as being formed on slash faces 120, 122, it is understood that distinct portions of unitary body 102 for turbine shroud 100 may include cavities 162 formed thereon. For example, and as shown in FIG. 3, cavities 162 may be formed on and/or extend over a portion forward end 106 of support portion 104 and/or forward hooks 130A, 130B formed integral with forward end 106.

Additionally, turbine shroud 100 may also include at least one hole 164 formed therein to reduce overall weight and/or material requirement for forming turbine shroud 100 from unitary body 102. In the non-limiting example shown in FIGS. 3 and 7, a plurality of holes 164 may be formed through support portion 104 of unitary body 102. That is, unitary body 102 may include holes 164 formed through first surface 126 and second surface 128 of support portion 104. Holes 164 may be formed adjacent forward end 106 of support portion 104. Additionally, holes 164 may also be formed through support portion 104 adjacent and/or radially above curved section 148 of non-linear segment 142 for intermediate portion 134. Similar to cavities 162, holes 164 formed in unitary body 102 of turbine shroud 100 may reduce the weight the of turbine shroud 100, add flexibility to turbine shroud 100, and/or reduce the material (and in turn manufacturing cost) required to build or additively manufacture turbine shroud 100.

Unitary body 102 may also include seal slots 166. Seal slots 166 may be formed in on and/or in first slash face 120 and second slash face 122, respectively. As shown in the non-limiting example of FIGS. 5 and 6, each of first slash face 120 and second slash face 122 may include a plurality of seal slots 166 formed on and/or extending over the respective face or surface. Each of the plurality of seal slots 166 may receive a sealing component (not shown) to interact with a sealing component of a circumferentially adjacent turbine shroud 100 used within turbine 28 (see, FIG. 2). Sealing components positioned within seal slots 166 of unitary body 102 for turbine shroud 100 may form a seal within turbine 28, define the flow path (FP) of combustion gases 26 flowing through turbine 28, and/or prevent leakage of combustion gases 26 into a cooling fluid discharge area for turbine shrouds 100.

In the non-limiting example shown in FIGS. 3 and 7, unitary body 102 for turbine shroud 100 may also include at least one inlet opening 168. Inlet opening(s) 168 may be formed in and/or through first surface 126 of support portion 104, between forward end 106 and aft end 108. Additionally, inlet opening(s) 168 may also be formed in first surface 126 and/or through support portion 104 axially downstream of non-linear segment 142 of intermediate portion 134. In a non-limiting example, inlet opening(s) 168 may be in fluid communication with a cooling circuit (not shown) formed through unitary body 102. More specifically, inlet opening(s) 168 formed in first surface 126 may extend through at least a portion of support portion 104, and may be in fluid communication with a cooling circuit formed through and/or included within support portion 104, intermediate portion 134, and/or seal portion 154 of unitary body 102.

Turning to FIG. 7, turbine shroud 100 may also include, for example, a meter plate 170 coupled to first surface 126 of support portion 104. Meter plate 170 may be affixed to first surface 126, over and/or at least partially covering inlet opening(s) 168 to regulate (e.g., amount, pressure) the cooling fluid that may flow through inlet opening(s) 168 to the cooling circuit (not shown) formed within turbine shroud 100. Meter plate 170 may be affixed and/or coupled to first surface 126 of support portion 104 using any suitable joining and/or coupling technique and/or process. In a non-limiting example where turbine shroud 100 includes meter plate 170, coupling meter plate 170 to first surface 126 to at least partially cover inlet opening 168 may be the only post-additive manufacturing process required to be performed on turbine shroud 100 before turbine shroud 100 is ready to be installed and/or used within turbine 28. As such, and as discussed herein, forming turbine shroud 100 to include unitary body 102, and the various features discussed herein, may reduce the cost, time, and/or process for building and installing turbine shroud 100 within turbine 28.

FIG. 8 shows an enlarged side view of turbine 28 including a single stage of turbine blades 38, two stages of state vanes 40A, 40B surround the single stage of turbine blades 38, and turbine shroud 100. It is understood that similarly numbered and/or named components may function in a substantially similar fashion. Redundant explanation of these components has been omitted for clarity.

In the non-limiting example shown in FIG. 8, turbine shroud 100 may be directly coupled to casing 36 of turbine 28. That is, turbine shroud 100 may be coupled to casing 36 and/or extension 52 of casing 36, radially adjacent and/or outward from tip portion 48 of airfoil 46 for turbine blades 38. In the non-limiting example, support portion 104 of unitary body 102 for turbine shroud 100 may be positioned within and/or received by opening 54 of extension 52. Additionally, forward hook(s) 130 formed integral with forward end 106 and aft hook(s) 132 formed integral with aft end 108 of support portion 104 may be positioned within opening 54 of extension 52, and may engage a portion of extension 52 to secure, fix, and/or couple turbine shroud 100 to casing 36 of turbine 28.

As discussed herein, forward segment 150 of intermediate portion 134 for unitary body 102 may utilized to secure stator vanes 40A within casing 36. For example, forward segment 150 may abut, contact, hold, and/or be positioned axially adjacent an upstream stage of stator vanes 40A included within turbine 28. In the non-limiting example shown in FIG. 8, forward segment 150, along with a retention seal 172 positioned and/or secured within shelf 152, may abut, contact, and/or provide a compressive force against a securing component 56, which may contact and/or be coupled to a platform 42A of stator vane 40A positioned upstream of turbine shroud 100.

Additionally as discussed herein, features formed on aft segment 136 of intermediate portion 134 may also aid and/or be used to secure stator vanes 40B within casing 36. For example, a portion of platform 42B of stator vane 40B positioned axially downstream of turbine shroud 100 may be positioned on flange 138, and/or secured between flanges 138, 140 formed integral with and extending (axially) from aft segment 136 of intermediate portion 134. In the non-limiting example, the portion of platform 42B of stator vane 40B may be positioned between flanges 138, 140, and/or rest on flange 138 (or flange 140 for turbine shrouds positioned radially below rotor 30 (see, FIG. 2)) to secure and/or fix stator vanes 40B within turbine casing 36 of turbine 28. To aid in securing stator vanes 40B within casing 36 and/or coupling platform 42B to turbine shroud 100, another retention seal 172 may be positioned between flanges 138, 140, and may contact the portion of platform 42B positioned between flanges 138, 140 of turbine shroud 100.

As discussed herein with respect to FIGS. 3-7, forward segment 150 of intermediate portion 134 and forward end 156 of seal portion 154 may extend axially upstream of the other portions and/or features of unitary body 102 for turbine shroud 100, and/or may be the axially-forward most portion of unitary body 102. That is, and as shown in FIG. 8, when turbine shroud 100 including unitary body 102 is positioned within turbine casing 36 for turbine 28, forward segment 150 of intermediate portion 134 and forward end 156 of seal portion 154 may be positioned axially upstream of forward end 106 of support portion 104, as well as the remaining portions/features of support portion 106. Additionally as shown in FIG. 8, forward segment 150 of intermediate portion 134 and forward end 156 of seal portion 154 may be positioned axially upstream of non-linear segment 142 of intermediate portion 134, as well as the remaining portion/features of intermediate portion 134. Forward segment 150 of intermediate portion 134 and forward end 156 of seal portion 154 may also be positioned axially upstream of all additional portions/features (e.g., HGP surface 160) of seal portion 154. In the non-limiting example, forward segment 150 of intermediate portion 134 and forward end 156 of seal portion 154 may be positioned axially upstream of extension 52 of turbine casing 36 as well. Because unitary body 102 includes support 104 and intermediate portion 134 having non-linear segment 142, forward segment 150 and forward end 156 may be positioned axially upstream of support portion 104 in a substantially cantilever manner or fashion without being directly coupled or connected to, and/or being formed integral with support portion 104. As a result, and as discussed herein, forward segment and forward end 156 may thermally expand during operation of turbine 28 without causing undesirable mechanical stress or strain on other portions (e.g., support portion 104, intermediate portion 134) of turbine shroud 100.

Turbine shroud 100 may be formed in a number of ways. In one embodiment, turbine shroud 100 may be made by casting. However, as noted herein, additive manufacturing is particularly suited for manufacturing turbine shroud 100 including unitary body 102. As used herein, additive manufacturing (AM) may include any process of producing an object through the successive layering of material rather than the removal of material, which is the case with conventional processes. Additive manufacturing can create complex geometries without the use of any sort of tools, molds or fixtures, and with little or no waste material. Instead of machining components from solid billets of plastic or metal, much of which is cut away and discarded, the only material used in additive manufacturing is what is required to shape the part. Additive manufacturing processes may include but are not limited to: 3D printing, rapid prototyping (RP), direct digital manufacturing (DDM), binder jetting, selective laser melting (SLM) and direct metal laser melting (DMLM). In the current setting, DMLM or SLM have been found advantageous.

Figure 9:
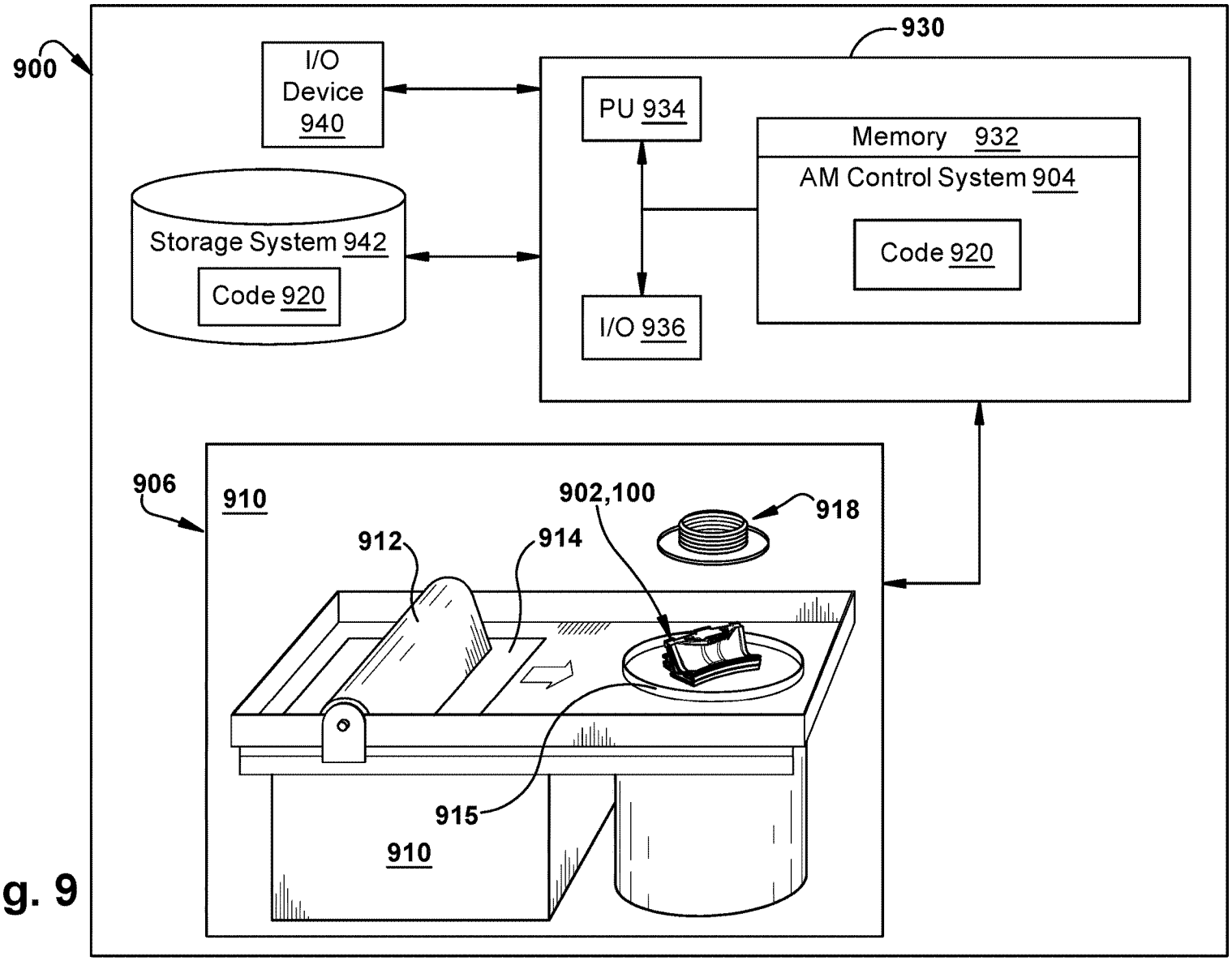
FIG. 9 shows a block diagram of an additive manufacturing process including a non-transitory computer readable storage medium storing code representative of a turbine shroud according to embodiments of the disclosure.

To illustrate an example of an additive manufacturing process, FIG. 9 shows a schematic/block view of an illustrative computerized additive manufacturing system 900 for generating an object 902. In this example, system 900 is arranged for DMLM. It is understood that the general teachings of the disclosure are equally applicable to other forms of additive manufacturing. Object 902 is illustrated as turbine shroud 100 (see, FIGS. 2-8). AM system 900 generally includes a computerized additive manufacturing (AM) control system 904 and an AM printer 906. AM system 900, as will be described, executes code 920 that includes a set of computer-executable instructions defining turbine shroud 100 to physically generate the object 902 using AM printer 906. Each AM process may use different raw materials in the form of, for example, fine-grain powder, liquid (e.g., polymers), sheet, etc., a stock of which may be held in a chamber 910 of AM printer 906. In the instant case, turbine shroud 100 may be made of a metal or metal compound capable of withstanding the environment of gas turbine system 10 (see, FIG. 1). As illustrated, an applicator 912 may create a thin layer of raw material 914 spread out as the blank canvas on a build plate 915 of AM printer 906 from which each successive slice of the final object will be created. In other cases, applicator 912 may directly apply or print the next layer onto a previous layer as defined by code 920, e.g., where a metal binder jetting process is used. In the example shown, a laser or electron beam 916 fuses particles for each slice, as defined by code 920, but this may not be necessary where a quick setting liquid plastic/polymer is employed. Various parts of AM printer 906 may move to accommodate the addition of each new layer, e.g., a build platform 918 may lower and/or chamber 910 and/or applicator 912 may rise after each layer.

AM control system 904 is shown implemented on computer 930 as computer program code. To this extent, computer 930 is shown including a memory 932, a processor 934, an input/output (I/O) interface 936, and a bus 938. Further, computer 930 is shown in communication with an external I/O device/resource 940 and a storage system 942. In general, processor 934 executes computer program code, such as AM control system 904, that is stored in memory 932 and/or storage system 942 under instructions from code 920 representative of turbine shroud 100, described herein. While executing computer program code, processor 934 can read and/or write data to/from memory 932, storage system 942, I/O device 940 and/or AM printer 906. Bus 938 provides a communication link between each of the components in computer 930, and I/O device 940 can comprise any device that enables a user to interact with computer 940 (e.g., keyboard, pointing device, display, etc.). Computer 930 is only representative of various possible combinations of hardware and software. For example, processor 934 may comprise a single processing unit, or be distributed across one or more processing units in one or more locations, e.g., on a client and server. Similarly, memory 932 and/or storage system 942 may reside at one or more physical locations. Memory 932 and/or storage system 942 can comprise any combination of various types of non-transitory computer readable storage medium including magnetic media, optical media, random access memory (RAM), read only memory (ROM), etc. Computer 930 can comprise any type of computing device such as a network server, a desktop computer, a laptop, a handheld device, a mobile phone, a pager, a personal data assistant, etc.

Additive manufacturing processes begin with a non-transitory computer readable storage medium (e.g., memory 932, storage system 942, etc.) storing code 920 representative of turbine shroud 100. As noted, code 920 includes a set of computer-executable instructions defining outer electrode that can be used to physically generate the tip, upon execution of the code by system 900. For example, code 920 may include a precisely defined 3D model of turbine shroud 100 and can be generated from any of a large variety of well-known computer aided design (CAD) software systems such as AutoCAD®, TurboCAD®, DesignCAD 3D Max, etc. In this regard, code 920 can take any now known or later developed file format. For example, code 920 may be in the Standard Tessellation Language (STL) which was created for stereolithography CAD programs of 3D Systems, or an additive manufacturing file (AMF), which is an American Society of Mechanical Engineers (ASME) standard that is an extensible markup-language (XML) based format designed to allow any CAD software to describe the shape and composition of any three-dimensional object to be fabricated on any AM printer. Code 920 may be translated between different formats, converted into a set of data signals and transmitted, received as a set of data signals and converted to code, stored, etc., as necessary. Code 920 may be an input to system 900 and may come from a part designer, an intellectual property (IP) provider, a design company, the operator or owner of system 900, or from other sources. In any event, AM control system 904 executes code 920, dividing turbine shroud 100 into a series of thin slices that it assembles using AM printer 906 in successive layers of liquid, powder, sheet or other material. In the DMLM example, each layer is melted to the exact geometry defined by code 920 and fused to the preceding layer. Subsequently, the turbine shroud 100 may be exposed to any variety of finishing processes, e.g., those described herein for re-contouring or other minor machining, sealing, polishing, etc.

Figure 10:
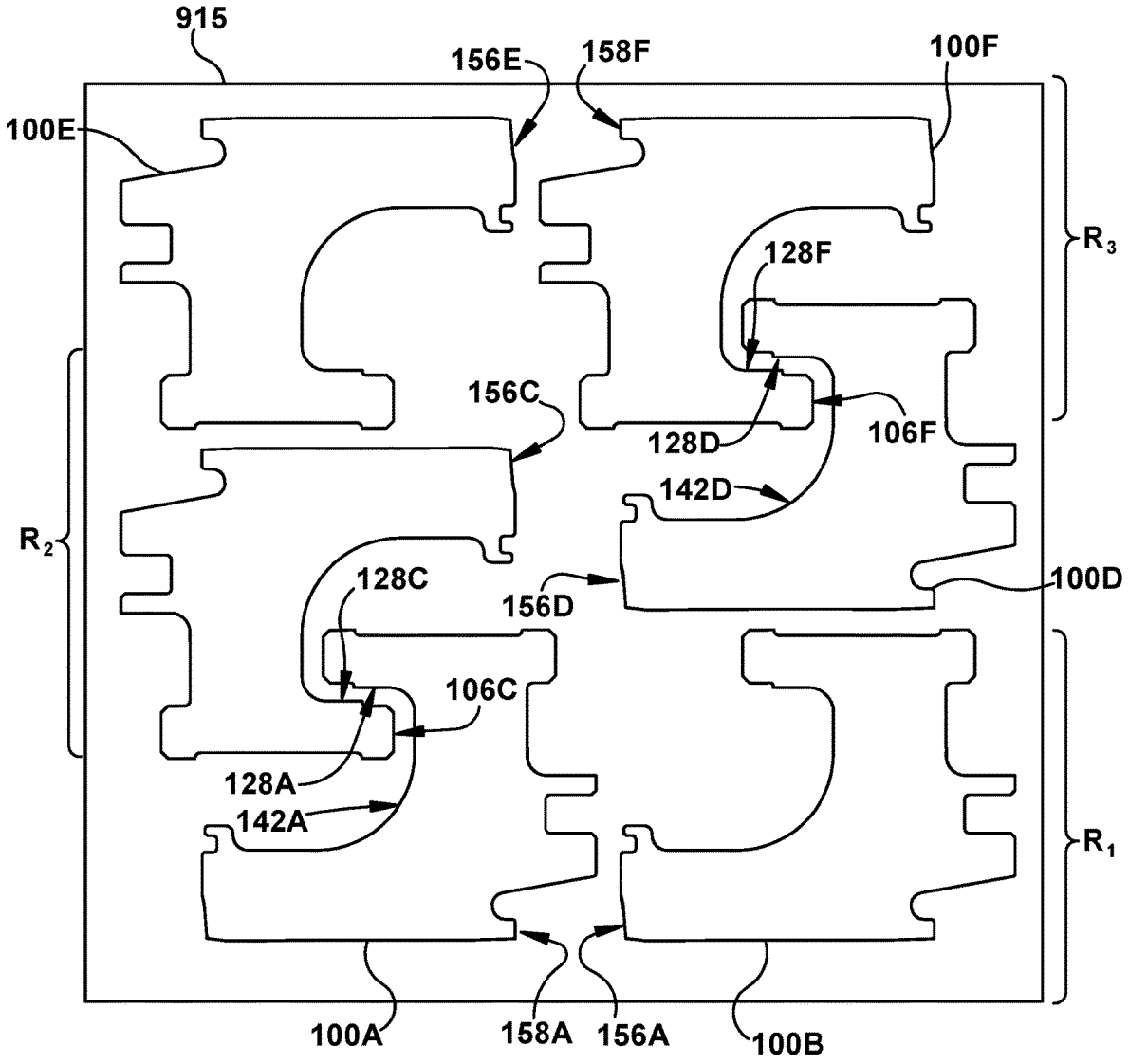
FIG. 10 shows a top view of a plurality of turbine shrouds printed on a single build plate utilized by the additive manufacturing system of FIG. 9, according to embodiments of the disclosure.

FIG. 10 shows a top view of a plurality of turbine shrouds 100 printed on a single build plate 915 of AM printer 906 shown, for example, in FIG. 9. It is understood that similarly numbered and/or named components may function in a substantially similar fashion. Redundant explanation of these components has been omitted for clarity.

The plurality of turbine shrouds 100 may be built on build plate 915 in a specific orientation to optimize the additive manufacturing build process discussed herein. For example, the maximum number of turbine shrouds 100 may be built on a single build plate 915 of AM printer 906 by manipulating the code 920 (see, FIG. 9) to arrange the turbine shrouds 100 in the pattern shown in FIG. 10. In the non-limiting example, a first row ($R_1$) of adjacent turbine shrouds 100A, 100B may be built on build plate 915 such that aft end 158A of first turbine shroud 100A may be positioned directly adjacent forward end 156B of second turbine shroud 100B. A second row ($R_2$) of adjacent turbine shrouds 100C, 100D may be built on build plate 915 adjacent the first row ($R_1$) such that forward end 156C of third turbine shroud 100C may be positioned directly adjacent forward end 156D of fourth turbine shroud 100D. Additionally in the non-limiting example, at least one turbine shroud 100C of second row ($R_2$) may be nested with at least one turbine shroud 100A of first row ($R_1$). Specifically, and as shown in FIG. 10, third turbine shroud 100C may be oriented in an inverted and mirrored position from first turbine shroud 100A, and forward end 106C of third turbine shroud 100C may extend adjacent non-linear segment 142A of first turbine shroud 100A. Additionally, a portion of second surface 128C of third turbine shroud 100C may be positioned directly adjacent a portion of second surface 128A of first turbine shroud 100A.

A third row ($R_3$) of adjacent turbine shrouds 100E, 100F may be built on build plate 915 adjacent the second row ($R_2$). In the non-limiting example, both the fifth turbine shroud 100E and sixth turbine shroud 100F may be oriented in the similar orientation as third turbine shroud 100C of the second row ($R_2$) (e.g., inverted and/or mirrored position of first turbine shroud 100A). As a result, aft end 158F of sixth turbine shroud 100F may be positioned directly adjacent forward end 156E of fifth turbine shroud 100E. Additionally, at least one turbine shroud 100F of third row ($R_3$) may be nested with at least one turbine shroud 100D of second row ($R_2$). Specifically, and as shown in FIG. 10, sixth turbine shroud 100F may be oriented in an inverted and mirrored position from fourth turbine shroud 100D, and forward end 106F of sixth turbine shroud 100F may extend adjacent non-linear segment 142D of fourth turbine shroud 100D. A portion of second surface 128F of sixth turbine shroud 100F may be positioned directly adjacent a portion of second surface 128D of fourth turbine shroud 100D as well.

Technical effects of the disclosure include, e.g., providing a turbine shroud formed from a unitary body that includes the hot gas path surface as well as a portion that may be coupled directly to the turbine casing if the turbine system. The unitary body of the turbine shroud (formed using additive manufacturing) allows the turbine shroud to be build or manufactured with reduced weight, added flexibility, and reduced material/manufacturing cost required to build or additively manufacture the turbine shroud.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. "Optional" or "optionally" means that the subsequently described event or circumstance may or may not occur, and that the description includes instances where the event occurs and instances where it does not.

Approximating language, as used herein throughout the specification and claims, may be applied to modify any quantitative representation that could permissibly vary without resulting in a change in the basic function to which it is related. Accordingly, a value modified by a term or terms, such as "about," "approximately" and "substantially," are not to be limited to the precise value specified. In at least some instances, the approximating language may correspond to the precision of an instrument for measuring the value. Here and throughout the specification and claims, range limitations may be combined and/or interchanged, such ranges are identified and include all the sub-ranges contained therein unless context or language indicates otherwise. "Approximately" as applied to a particular value of a range applies to both values, and unless otherwise dependent on the precision of the instrument measuring the value, may indicate +/−10% of the stated value(s).

The corresponding structures, materials, acts, and equivalents of all means or step plus function elements in the claims below are intended to include any structure, material, or act for performing the function in combination with other claimed elements as specifically claimed. The description of the present disclosure has been presented for purposes of illustration and description, but is not intended to be exhaustive or limited to the disclosure in the form disclosed. Many modifications and variations will be apparent to those of ordinary skill in the art without departing from the scope and spirit of the disclosure. The embodiment was chosen and described in order to best explain the principles of the disclosure and the practical application, and to enable others of ordinary skill in the art to understand the disclosure for various embodiments with various modifications as are suited to the particular use contemplated.

What is claimed is:

1. A turbine shroud for a turbine system, the turbine shroud comprising:

a unitary body including:

a support portion coupled directly to a turbine casing of the turbine system, the support portion including a forward end, an aft end positioned opposite the forward end, a first surface that faces radially outwardly formed between the forward end and the aft end, and a second surface that faces radially inwardly formed between the forward end and the aft end, opposite wherein the second surface is radially the first surface, at least one forward hook formed integral with the forward end of the support portion, the at least one forward hook extending radially outward from the first surface of the support portion, at least one aft hook formed integral with the aft end of the support portion, the at least one aft hook extending radially outward from the first surface of the support portion, an intermediate portion integral with the second surface of the support portion, the intermediate portion including:

an aft segment extending perpendicularly away from the second surface of the support portion, a non-linear segment extending radially inwardly away from the second surface of the support portion, adjacent the aft segment, the non-linear segment including:

a first end formed integral with the second surface of the support portion between the forward end and the aft end, a second end positioned circumferentially opposite the first end, the second end positioned axially upstream of the at least one forward hook, a curved section extending between the first end and the second end; and a forward segment formed integral with the second end of the non-linear segment, the forward segment positioned axially upstream of the at least one forward hook; and a seal portion integral with and extending radially inward from the intermediate portion, the seal portion including:

a forward end formed integral with the forward segment of the intermediate portion, the forward end positioned axially upstream of the at least one forward hook, an aft end positioned opposite the forward end, the aft end formed integral with the aft segment of the intermediate portion, and a hot gas path (HGP) surface extending between the forward end and aft end, the HGP surface positioned adjacent a hot gas flow path for the turbine system.

2. The turbine shroud of claim 1, wherein the unitary body further includes:

a first slash face extending adjacent to and between the first surface of the support portion and the HGP surface of the seal portion, and a second slash face positioned circumferentially opposite the first slash face, the second slash face extending adjacent to and between the first surface of the support portion and the HGP surface of the seal portion.

3. The turbine shroud of claim 2, wherein the at least one forward hook includes:

two forward hooks formed integral with and centrally positioned on the forward end of the support portion between the first slash face and the second slash face.

4. The turbine shroud of claim 3, wherein the at least one aft hook includes:

a first aft hook formed integral with and centrally positioned on the aft end of the support portion between the first slash face and the second slash face, a second aft hook formed integral with the aft end of the support portion, directly adjacent the first slash face, and a third aft hook formed integral with the aft end of the support portion, directly adjacent the second slash face.

5. The turbine shroud of claim 2, wherein the forward segment of the intermediate portion further includes a shelf extending between the first slash face and the second slash face.

6. The turbine shroud of claim 2, wherein the unitary body further includes at least one cavity formed on at least one of the first slash face or the second slash face.

7. The turbine shroud of claim 2, wherein the unitary body further includes at least one seal slot formed on the first slash face and the second slash face.

8. The turbine shroud of claim 1, wherein the unitary body further includes at least one inlet opening formed in the first surface of the support portion, the at least one inlet opening in fluid communication with a cooling circuit formed through the support portion, the intermediate portion, and the seal portion.

9. The turbine shroud of claim 8, further comprising a meter plate affixed to the first surface of the support portion, the meter plate positioned over the at least one inlet opening formed in the first surface of the support portion.

10. The turbine shroud of claim 1, wherein the unitary body further includes at least one hole extending through the first surface and the second surface of the support portion, the at least one hole formed adjacent the curved section of the non-linear segment for the intermediate portion.

11. A turbine shroud for a turbine system, the turbine shroud comprising:

a unitary body including:

a support portion coupled directly to a turbine casing of the turbine system, the support portion including a forward end, an aft end positioned opposite the forward end, a first surface that faces radially outwardly formed between the forward end and the aft end, and a second surface that faces radially inwardly formed between the forward end and the aft end, wherein the second surface is radially opposite the first surface, at least one forward hook formed integral with the forward end of the support portion, the at least one forward hook extending radially outward from the first surface of the support portion, at least one aft hook formed integral with the aft end of the support portion, the at least one aft hook extending radially outward from the first surface of the support portion, an intermediate portion integral with the second surface of the support portion, the intermediate portion including:

an aft segment extending perpendicularly away from the second surface of the support portion, a non-linear segment extending radially inwardly away from the second surface of the support portion, adjacent the aft segment, the non-linear segment including:

a first end formed integral with the second surface of the support portion between the forward end and the aft end, a second end positioned circumferentially opposite the first end, the second end positioned axially upstream of the at least one forward hook, a curved section extending between the first end and the second end; and a forward segment formed integral with the second end of the non-linear segment, the forward segment positioned axially upstream of the at least one forward hook; and a seal portion integral with and extending radially inward from the intermediate portion, the seal portion including:

a forward end formed integral with the forward segment of the intermediate portion, the forward end positioned axially upstream of the at least one forward hook, an aft end positioned opposite the forward end, the aft end formed integral with the aft segment of the intermediate portion, and a hot gas path (HGP) surface extending between the forward end and aft end, the HGP surface positioned adjacent a hot gas flow path for the turbine system, wherein unitary body further includes at least one flange formed integral with and extending from the aft segment of the intermediate portion.

12. A turbine system comprising:

a turbine casing;

a rotor extending axially through the turbine casing;

a plurality of turbine blades positioned circumferentially about and extending radially from the rotor; and a plurality of turbine shrouds directly coupled to the turbine casing and positioned radially between the turbine casing and the plurality of turbine blades, each of the plurality of turbine shrouds including:

a unitary body including:

a support portion coupled directly to the turbine casing, the support portion including a forward end, an aft end positioned opposite the forward end, a first surface that faces radially outwardly formed between the forward end and the aft end, and a second surface that faces radially inwardly formed between the forward end and the aft end, wherein the second surface is radially opposite the first surface, at least one forward hook formed integral with the forward end of the support portion, the at least one forward hook extending radially outward from the first surface of the support portion, at least one aft hook formed integral with the aft end of the support portion, the at least one aft hook extending radially outward from the first surface of the support portion, an intermediate portion integral with the second surface of the support portion, the intermediate portion including:

an aft segment extending inward from the second surface of the support portion, a non-linear segment radially inwardly away from the second surface of the support portion, adjacent the aft segment, the non-linear segment including:

a first end formed integral with the second surface of the support portion between the forward end and the aft end, a second end positioned circumferentially opposite the first end, the second end positioned axially upstream of the at least one forward hook, a curved section extending between the first end and the second end; and a forward segment formed integral with the second end of the non-linear segment, the forward segment positioned axially upstream of the at least one forward hook; and a seal portion integral with and extending radially inward from the intermediate portion, the seal portion including:

a forward end formed integral with the forward segment of the intermediate portion, the forward end positioned axially upstream of the at least one forward hook, an aft end positioned opposite the forward end, the aft end formed integral with the aft segment of the intermediate portion, and a hot gas path (HGP) surface extending between the forward end and aft end, the HGP surface positioned adjacent a hot gas flow path for the turbine system.

13. The turbine system of claim 12, wherein the unitary body of each turbine shroud of the plurality of turbine shrouds further includes:

a first slash face extending adjacent to and between the first surface of the support portion and the HGP surface of the seal portion, and a second slash face positioned circumferentially opposite the first slash face, the second slash face extending adjacent to and between the first surface of the support portion and the HGP surface of the seal portion.

14. The turbine system of claim 13, wherein the at least one forward hook of each of the plurality of turbine shrouds includes:

two forward hooks formed integral with and centrally positioned on the forward end of the support portion between the first slash face and the second slash face.

15. The turbine system of claim 14, wherein the at least one aft hook of each of the plurality of turbine shrouds includes:

a first aft hook formed integral with and centrally positioned on the aft end of the support portion between the first slash face and the second slash face, a second aft hook formed integral with the aft end of the support portion, directly adjacent the first slash face; and a third aft hook formed integral with the aft end of the support portion, directly adjacent the second slash face.

16. The turbine system of claim 13, wherein the forward segment of the intermediate portion of each of the plurality of turbine shrouds further includes a shelf extending between the first slash face and the second slash face.

17. The turbine system of claim 13, wherein the unitary body of each of the plurality of turbine shrouds further includes at least one cavity formed on at least one of the first slash face or the second slash face.

18. The turbine system of claim 12, wherein the unitary body of each of the plurality of turbine shrouds further includes:

at least one inlet opening formed in the first surface of the support portion, the at least one inlet opening in fluid communication with a cooling circuit formed through the support portion, the intermediate portion, and the seal portion.

19. The turbine system of claim 18, wherein each of the plurality of turbine shrouds further comprises:

a meter plate affixed to the first surface of the support portion, the meter plate positioned over the at least one inlet opening formed in the first surface of the support portion.

20. The turbine system of claim 12, wherein the unitary body of each of the plurality of turbine shrouds further includes:

at least one hole extending through the first surface and the second surface of the support portion, the at least one hole formed adjacent the curved section of the non-linear segment for the intermediate portion.

* * * * *